US007510047B2

(12) United States Patent
Muto et al.

(10) Patent No.: US 7,510,047 B2
(45) Date of Patent: Mar. 31, 2009

(54) SPEAKER EDGE AND RESONATOR PANEL ASSEMBLY

(76) Inventors: Keiko Muto, 13816 Bora Bora Way, A340, Marina Del Rey, CA (US) 90292; Mayuki Yanagawa, 13816 Bora Bora Way, A340, Marina Del Rey, CA (US) 90292

( * ) Notice: Subject to any disclaimer, the term of this patent is extended or adjusted under 35 U.S.C. 154(b) by 11 days.

(21) Appl. No.: 11/867,620

(22) Filed: Oct. 4, 2007

(65) Prior Publication Data

US 2008/0023259 A1 Jan. 31, 2008

Related U.S. Application Data

(63) Continuation-in-part of application No. 10/794,479, filed on Mar. 5, 2004, now abandoned.

(51) Int. Cl.

| | |
|---|---|
| ***G10K 13/00*** | (2006.01) |
| ***H04R 7/06*** | (2006.01) |
| ***H04R 7/20*** | (2006.01) |
| ***H04R 1/22*** | (2006.01) |
| *H04R 7/04* | (2006.01) |
| *H04R 7/16* | (2006.01) |

(52) U.S. Cl. ..... 181/173; 181/171; 381/392; 381/423; 381/431

(58) Field of Classification Search ..... 181/174, 181/173, 171, 172, 157, 166–170; 381/386, 381/392, 395, 423, 425–428, 431
See application file for complete search history.

(56) References Cited

U.S. PATENT DOCUMENTS 1,080,953 A * 12/1913 Catucci ..... 181/164
1,870,417 A * 8/1932 Mallina ..... 181/170
3,980,841 A * 9/1976 Okamura et al. ..... 181/294
4,472,604 A * 9/1984 Nakamura et al. ..... 381/425
4,477,699 A * 10/1984 Wada et al. ..... 381/184
5,251,188 A * 10/1993 Parsons et al. ..... 367/140
5,371,805 A * 12/1994 Saiki et al. ..... 381/398
5,455,396 A * 10/1995 Willard et al. ..... 181/172
5,578,800 A * 11/1996 Kijima ..... 181/171
5,664,024 A * 9/1997 Furuta et al. ..... 381/412
5,740,264 A * 4/1998 Kojima ..... 381/423

(Continued)

*Primary Examiner*—Edgardo San Martin
(74) *Attorney, Agent, or Firm*—Bruce A. Jagger

(57) ABSTRACT

A complex speaker edge and asymmetric resonator panel in which the acoustic vibration damping capacity of the speaker edge varies longitudinally around the speaker edge. The resonator panel has an aspect ratio of approximately 1.3:1 or more, and is composed of top and bottom panels held in spaced apart relationship by a plurality of longitudinally extending ribs extending therebetween. The ribs extend at an angle of from approximately 5 to 35 degrees to the longitudinal axis of the panel. The angle is acoustically matched to the complex speaker edge to improve the accuracy with which said acoustic vibration is reproduced. The effectiveness of the differential damping capacity of the edge in improving the quality of sound output from a speaker assembly is determined by observing the average magnitude of the excursions of the sound level pressure versus frequency curves for comparable complex and single speaker edges, particularly in the 200 to 10,000 Hertz range. The speaker edge and the angle of the ribs are acoustically matched by iteratively adjusting the edge and/or the angle in response to the quality of the sound that is perceived by a trained human ear.

10 Claims, 7 Drawing Sheets

U.S. PATENT DOCUMENTS 6,039,145 A * 3/2000 Ogura et al. ..... 181/167
6,305,491 B2 * 10/2001 Iwasa et al. ..... 181/172
6,341,167 B1 * 1/2002 Okuyama et al. ..... 381/407
6,385,327 B1 * 5/2002 D'Hoogh ..... 381/398
6,411,723 B1 * 6/2002 Lock et al. ..... 381/431
6,505,705 B1 * 1/2003 Espiritu et al. ..... 181/150
6,594,372 B2 * 7/2003 Nakaso ..... 381/396
6,611,604 B1 * 8/2003 Irby et al. ..... 381/398
6,654,475 B2 * 11/2003 Nakaso ..... 381/396
6,680,430 B2 * 1/2004 Tabata et al. ..... 84/171
6,687,381 B2 * 2/2004 Yanagawa et al. ..... 381/423
6,920,957 B2 * 7/2005 Usuki et al. ..... 181/173
6,944,310 B2 * 9/2005 Ito et al. ..... 381/386
7,120,263 B2 * 10/2006 Azima et al. ..... 381/152
7,416,047 B2 * 8/2008 Frasl et al. ..... 181/173
7,447,328 B2 * 11/2008 Takewa et al. ..... 381/424
2001/0022846 A1 * 9/2001 Ishigaki et al. ..... 381/398
2002/0170774 A1 * 11/2002 Ishigaki ..... 181/171
2002/0172392 A1 * 11/2002 Iwasa et al. ..... 381/413
2003/0070869 A1 * 4/2003 Hlibowicki ..... 181/172
2003/0231784 A1 * 12/2003 Kuze et al. ..... 381/386
2004/0026164 A1 * 2/2004 Takahashi et al. ..... 181/171

* cited by examiner

Fig. 4
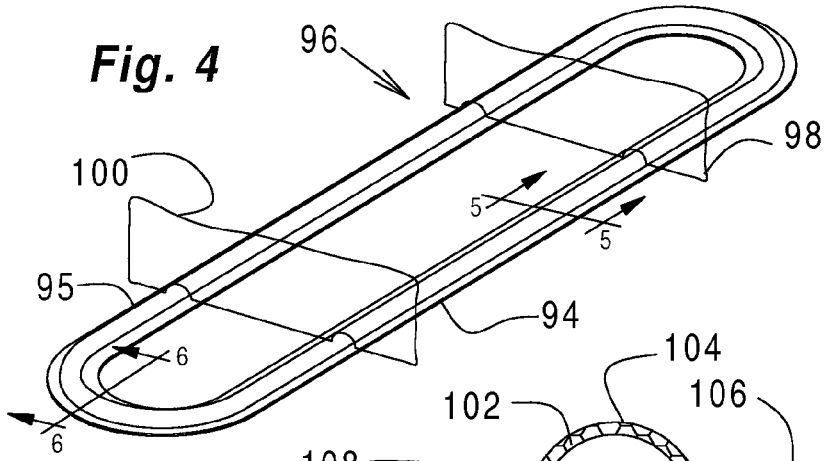
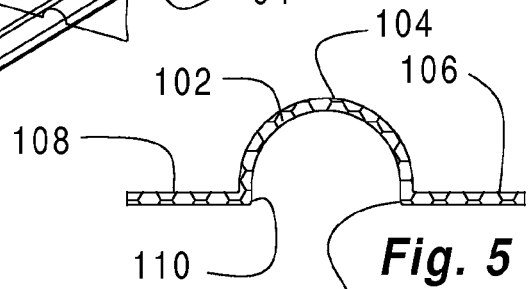
Fig. 5
Fig. 6
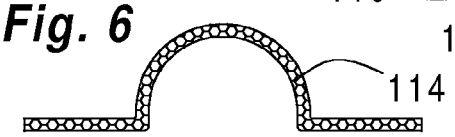
Fig. 7
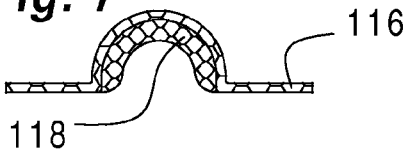
Fig. 8
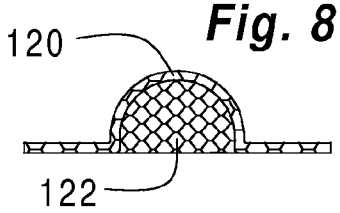
Fig. 9
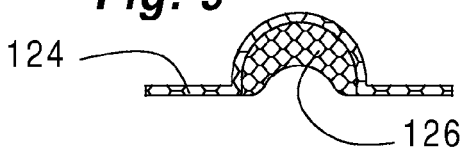
Fig. 10
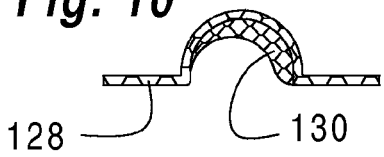

SPEAKER EDGE AND RESONATOR PANEL ASSEMBLY

RELATED APPLICATIONS

This is a continuation-in-part of Ser. No. 10/794,479, filed Mar. 5, 2004 now abandoned.

BACKGROUND OF THE INVENTION

1. Field of the Invention

The invention relates in general to the interrelationship between complex speaker edges and especially configured resonator panels wherein speakers with high aspect ratio ribbed resonator plates are mounted to supporting frames through complex speaker edges. Embodiments include complex speaker edges with non-uniform vibration damping profiles or characteristics around their peripheries, and resonator plates with non-axially aligned ribs. In this field, the quality of the emitted sound is optimized, for example, by matching the vibration damping profile and the angle at which the ribs extend.

2. Description of the Prior Art

Speaker edges composed of various flexible materials had been widely employed in the mounting of acoustic vibration plates, particularly conical shaped vibration plates, to supporting housings or frames. See, for example, Okamura et al. U.S. Pat. No. 3,980,841, and Tabata et al. U.S. Pat. No. 6,680,430. Typically, the prior proposed speaker edges had been round and deployed on the edges of conical resonator plates.

It is well known that speaker edges substantially improve the characteristics of the sound that is generated by a speaker. It had been proposed to construct speaker edges from various flexible materials including, for example, cloth, foamed rubber, foamed urethane, compressed foamed urethane, other flexible thermoplastic and thermosetting materials, and the like. Tabata et al. teaches that speaker edges made from thermally compressed foam are not satisfactory because, inter alia, the densities of the compressed foam speaker edges supposedly vary randomly. Talbata et al. teaches that longitudinal uniformity is necessary throughout a foamed speaker edge. Talbata et al allegedly achieves longitudinal uniformity by foaming the material of construction for the speaker edges in situ, rather than by compressing pre-formed foam blocks.

Rectangular planar resonator plates with high aspect ratios for use in flat elongated speaker assemblies had been described previously. See Yanagawa et al. U.S. Pat. No. 6,687,381. Flat speaker assemblies are configured to fit into small generally narrow spaces. Such flat speaker assemblies generally employ flat resonator panels in place of the large speaker cones that are typically found in more bulky speaker assemblies. The flat resonator panels are typically elongated so that they have high aspect ratios.

Speakers containing high aspect ratio planar resonator plates had presented problems in achieving the desired sound quality. While not wishing to be bound by any theory, this is believed to be at least partly due to the existence of undesirable standing waves in the resonator plates. It is believed that these standing waves cause cancellation of the desired sound waves. The existence of such cancellation or interference is detectable by measuring the sound pressure levels of the acoustic output from the speaker assembly over the range of frequencies that are detectable by the human ear. It is generally desired by the art that a speaker assembly generate a curve of frequency versus sound pressure level that is as flat as possible. That is, in the desired condition this curve exhibits approximately a constant sound pressure level between approximately 20 and 20,000 Hertz. It is inevitable that this curve will fluctuate somewhat from the average. The art recognizes that the magnitude of the excursions in this curve from the average sound pressure level should be as small as possible. As is well known to those in the art, various well recognized standards have been promulgated and now exist for measuring such acoustic output. Such standards generally vary from jurisdiction to jurisdiction, as is well understood by those skilled in the art, but typically require the use of a microphone spaced a set distance, for example, one meter, from the speaker that is being tested.

The problems encountered in achieving the desired sound quality had generally limited the usage of high aspect ratio planar resonator plates. As noted, for example, by Okamura et al. U.S. Pat. No. 3,980,841, tuning a speaker to get the desired quality of sound is often a delicate matter. Insofar as possible, the characteristics of a speaker edge should not be so sensitive to variations in materials and dimensions that manufacturing tolerances become prohibitively expensive to control.

Various resonator plates or diaphragms of different constructions had been previously suggested. Anisotropic rectangular and elliptical diaphragms constructed with double-skins spaced apart by parallel walls extending between the skins had been previously proposed. See, for example, Lock et al. U.S. Pat. No. 6,411,723. According to Lock et al., the walls extend longitudinally so that the longitudinal bending strength is greater than the transverse bending strength. There is no teaching or suggestion as to any orientation of the walls other than parallel or transverse to the edges of the diaphragm, or that there would be any advantage to orienting the walls at any other angle.

Elongated resonator panels with resonance inhibiting layers in the edge region in the major-axis direction had been proposed. See Takahashi Publication No. US 2004/0026164, published Feb. 12, 2004.

Attempts to solve these problems were generally unsuccessful. An individual with a well trained ear could generally detect that the sound emitted by prior art devices was of a quality that was inferior to that of the original source, particularly for musical performances. Instruments were generally inadequate to identify and quantify the exact nature of the inferior quality. Those concerned with these problems recognize the need for an improvement.

These and other difficulties of the prior art have been overcome according to the present invention.

BRIEF SUMMARY OF THE INVENTION

The present invention has been developed in response to the current state of the art, and in particular, in response to these and other problems and needs that have not been fully or completely solved by currently available expedients. Thus, it is an overall object of the present invention to effectively resolve at least the problems and shortcomings identified herein. In particular, embodiments provide a speaker edge with a non-uniform vibration damping profile or characteristics around its periphery (a complex speaker edge), and a ribbed elongated resonator panel in which the ribs are not aligned with the longitudinal or lateral axis of the elongated resonator panel.

Embodiments of the elongated resonator panels are asymmetric in that the major or longitudinal axis is longer than the minor or lateral axis. Asymmetric resonator panels are useful in a wide variety of applications where it is desired to shape them to fit the physical configuration of the available space. Embodiments of asymmetrical resonator panels include, for example, such panels with generally rectangular, oval, teardrop, combinations thereof, and the like, shaped plan forms wherein such panels are generally planer or arcuate with simple or compound curved surfaces.

Embodiments provide speaker edges in which the non-uniform acoustic vibration damping profiles around their peripheries can be selected to accommodate planar elongated resonator panels having various aspect ratios, and the angle of the ribs can be acoustically matched to the speaker edges, or vice versa, to provide a desired quality of emitted sound. That is, in certain embodiments the non-uniform acoustic damping profiles of the speaker edges can be selected to match the vibration damping requirements that are dictated by the aspect ratios of the associated elongated resonator panels, and the angle of the ribs can be adjusted until the quality of the emitted sound is optimized.

The damping profiles of the elongated resonator panels, the aspect ratios of the elongated resonator panels, and the angles of the ribs can be adjusted relative to one another according to the teachings herein to provide the desired quality of the sounds emitted by a speaker assembly. In embodiments where the aspect ratio of the elongated resonator panel is dictated by the physical configuration that it is intended to be used in, the damping profile of the speaker edge is typically dictated by the characteristics of the elongated resonator panel. The optimization of the speaker edge-elongated resonator panel assembly for the desired emitted sound characteristics is then typically accomplished by adjusting the rib angle until a worker with a trained ear is satisfied with the emitted sound. In other embodiments where, for example, the rib angle or damping profile are fixed, the other variables are adjusted around the fixed variable as may be necessary to accomplish the desired quality of the emitted sound.

In general, the acoustic vibration damping capacity of the speaker edge should increase roughly proportionally to the distance from the source of vibration. Such increase in acoustic damping capacity can increase, for example, in one or more steps or at a constant rate. The speaker edge exhibits two or more different acoustic damping capacities, each in its own section of the speaker edge. The rate of acoustic damping capacity increase longitudinally of the speaker edge need not necessarily be uniform, and it often is not.

Manufacturing considerations often dictate that the acoustic damping profile of a speaker edge be changed abruptly from one vibration damping level to another. Embodiments provides the flexibility to accommodate such abrupt changes in the acoustic vibration damping profile of a speaker edge without unacceptably degrading the performance of the speaker. The characteristics of the acoustic output from a speaker assembly often depends somewhat on the shape and location of the juncture between the acoustically different sections. Certain embodiments are suitable for use in flat highly elongated speakers such as are typically placed on the edges of planar computer and television displays or the like wherein the aspect ratio of the planar elongated resonator is as much as approximately 2 to 1 or more. Embodiments of elongated resonator panels include, for example, generally flat panels, and generally arcuate panels with simple or compound curves.

The angle of the ribs that extend between the opposed panels in the elongated resonator panel may be varied from approximately 5 to 35 degrees from the longitudinal axis of the elongated resonator panel. In general, in optimizing an embodiment by varying the angle of the ribs, all other variables being held constant, the quality of higher frequency sounds improves as the angle increases, and the quality of the lower frequency sounds improves as the angle of the ribs decreases. Quality is determined by a trained human ear, because instruments are generally not capable of making the fine distinctions that are required in the final optimization of the speaker assembly.

In certain embodiments, the speaker edge is optimized for flatness of the sound level pressure-frequency curve as much as possible before the angle of the ribs is adjusted. The adjustment of the rib angle is often, but not necessarily, the final step in optimizing the quality of sound that is emitted.

Determination of the best rib angle for a particular speaker assembly is generally an iterative process in which various rib angles are tested to determine the optimum angle. The optimum rib angles for two otherwise similar speaker assemblies wherein the elongated resonator panels have different aspect ratios will often be different by 5 degrees or more. Also, the optimum rib angles will often change as a speaker assembly is scaled from one size to another, even though the proportions remain the same. Optimization may involve finding the optimum rib angle for a full range of sound frequencies, or just for a part of the sound spectrum. A rib angle that is optimized for the full range of audible frequencies is generally not the best rib angle for maximizing the quality of any one specific frequency. Rather, it is a compromise that provides the best overall sound quality. Sometimes it is necessary to readjust the characteristics of the speaker edge before an optimum rib angle can be determined, or vice versa. A change in the characteristics of the speaker edge will often, but not necessarily, change the optimum rib angle.

Certain embodiments comprise an elongated resonator panel with an aspect ratio of greater than about 1.3 to 1, with further embodiments having an aspect ratio of greater than about 2 to 1. An acoustic vibration source is operatively associated therewith. The elongated resonator panel is mounted to a supporting frame through a speaker edge. The frame is generally mounted in a suitable housing for purposes of appearance and protection of the speaker assembly.

A generally radially outer edge of a speaker edge is preferably affixed to a support frame, and the opposed radially inner edge is preferably affixed to an elongated resonator panel. The elongated resonator panel is vibrationally isolated from the frame by the speaker edge so that it is free to vibrate in the desired acoustic range without interference from the frame. Adhesives, sonic welding, thermal welding, in situ molding, or the like can be employed to affixingly associate the respective radial edges with the respective adjacent elements within the speaker assembly.

A source of acoustic vibrating energy can be vibratingly associated with a resonator panel by, for example, attachment at a location intermediate the peripheral edges of the panel, or the like. The source of vibrating energy drives the resonator panel to generate the desired sounds. Typical sources of acoustic vibrating energy include, for example magnetic driver-radiator constructs, piezoelectric elements, and the like, as are well known in the art. A typical radiator construct includes, for example, a truncated cone attached at its large end to the elongated resonator panel and at its small end to a driver.

Speaker edge embodiments are conveniently constructed, for example, by thermal compression of blocks of polymeric foam, by formation in situ in a mold from generally liquid precursors, or the like. The acoustic vibration damping profile of the speaker edge can be varied, for example, by changing its form, its properties, or both from one peripheral location to another around the speaker edge. That is, the acoustic vibration damping properties of the speaker edge vary from one longitudinal section to another around the speaker edge. Such changes in form can be wrought, for example, by using physically or chemically different materials of construction, different quantities or proportions of the same or different materials of construction, different processing parameters, different physical forms, or the like. Various materials such as, for example, polyurethane, polystyrene, polyolefins, synthetic rubbers, or the like can be used for the construction of the complex speaker edges of the present invention. It is generally preferred that the acoustic damping capacities of the respective sections of the speaker edge be roughly proportional to the radial distance of those sections from the source of acoustic radiation. Typically, the greater the radial distance of a section from the source of acoustic radiation, the greater its acoustic vibration damping capacity, although the inverse configuration can be employed. The use of a configuration wherein the acoustic vibration capacity is greater in the radially closer sections of the speaker edge may be indicated where efforts to achieve the desired flatness of the sound level pressure-frequency curve have been unsatisfactory.

One convenient way of varying the physical properties, and thus the acoustic vibration damping characteristics, along the circumference of the speaker edge is to use more pre-formed foamed polymeric material in one area and thermally compress it more in one section to get a speaker edge with a uniform physical form but with longitudinally varying physical properties. The material is generally denser, stiffer, and exhibits more acoustic vibration damping influence or capacity where there is more material compressed into the same volume.

The use of different materials of construction will provide different acoustic vibration damping characteristics. If, for example, one peripheral section of the speaker edge is thermally compressed polyurethane foam, and a second adjacent peripheral section is thermally compressed polyethylene foam, the two sections will be vibrationally differentiated from one another even where the physical form in both cross and longitudinal section are the same throughout both sections.

For ease of construction, it is often preferred, although not necessary, that the physical form of the speaker edge be uniform. Changing the physical form of the speaker edge is often effective in changing its acoustic vibration damping characteristics. The acoustic vibration damping characteristics will vary where one or more of the cross-sectional or longitudinal-sectional form, or area, or both of one section is different from that in a second section.

The non-uniform vibration damping characteristics of the speaker edge substantially influence the quality of the sound emitted by the speaker. For a round resonator plate with the vibration emitter located in the center of the plate, the vibration damping characteristics of the speaker edge should generally be substantially uniform. If the vibration emitter is shifted away from the center, the speaker edge should be configured so that the section of the speaker edge that is radially furthest from the vibration emitter damps vibrations more strongly than does the section closest to the vibration emitter. Where, for example, a square resonator panel is employed the speaker edge at the corners should generally damp the acoustic vibrations more strongly than at the midpoints of the sides. As the aspect ratio of the resonator panel increases the acoustic vibration damping profile of the speaker edge should show an increased damping capacity in the sections that are furthest from the vibration emitter.

While acoustic parameters such as volume and frequency can be accurately measured with suitable instruments, the final arbiter of the quality of the sound from a speaker is a trained human ear. Final adjustments to the vibration damping characteristics of the various sections of a speaker edge will usually be made by trial and error. The measuring instrument used in making such final trial and error adjustments will be the trained human ear. The predetermined non-uniform acoustic vibrational damping provided according to the present invention is tolerant enough of small manufacturing variations that speaker systems employing it can be mass produced at a reasonable cost while maintaining substantially the same acoustic characteristics.

Embodiments of resonator panels are often produced, for example, as large sheets from which individual resonator panels are cut. Sheets from which resonator panels are formed are often made by extrusion with the internal ribs and the opposed outer panels being formed in one continuous piece at the same time.

The cross-sectional height to width proportions of the elongated internal chambers formed by the walls and the opposed panels may vary widely as to proportioning, but generally fall within the range of from approximately 1 to 1 to 1 to 30. Height to width proportions of from approximately 1 to 5 to 1 to 15 are often used. The resonator panels are generally lightweight and rigid so that they are very responsive to the vibration that is imparted to them. The resonator panels are generally from approximately on-eighth to one-half, or three-sixteenths to three-eighths inches in thickness. Resonator panels may also be constructed from materials that can not be extruded, for example, by forming the panels and the walls separately and bonding them together, or by forming elongated channels and bonding them edge to edge. Other resonator panel forming operations may be employed as may be necessary or desirable.

To acquaint persons skilled in the pertinent arts most closely related to the present invention, an embodiment of a complex speaker edge that illustrates a best mode now contemplated is described herein by, and with reference to, the annexed drawings that form a part of the specification. The exemplary speaker assembly is described in detail without attempting to show all of the possible various forms and modifications. As such, the embodiments shown and described herein are illustrative, and as will become apparent to those skilled in the arts, can be modified in numerous ways within the scope and spirit of the invention, the invention being measured by the appended claims and not by the details of the specification or drawings.

Other objects, advantages, and novel features of the present invention will become more fully apparent from the following detailed description when considered in conjunction with the accompanying drawings, or may be learned by the practice of the invention.

BRIEF DESCRIPTION OF THE DRAWINGS

The present invention provides its benefits across a broad spectrum of speaker assemblies. While the description which follows hereinafter is meant to be representative of a number of such applications, it is not exhaustive. As those skilled in the art will recognize, the basic apparatus taught herein can be readily adapted to many uses. This specification and the claims appended hereto should be accorded a breadth in keeping with the scope and spirit of the invention being disclosed despite what might appear to be limiting language imposed by the requirements of referring to the specific examples disclosed.

Referring particularly to the drawings for the purposes of illustration only and not limitation:

FIG. 4 is a diagrammatic perspective view of a speaker edge that provides orientation information for FIGS. 5 through 10.

FIG. 5 is a cross-sectional view taken along section line 5-5 in FIG. 4 wherein a section of the thermally compressed polymeric foam contains a first volume of material.

FIG. 6 is a cross-sectional view taken along section line 6-6 in FIG. 4 wherein a section of the thermally compressed polymeric foam contains a second volume of material, which second volume is substantially greater than the first volume at section 5-5.

FIG. 7 is a cross-sectional view similar to FIG. 6 showing a further embodiment wherein a section of the thermally compressed polymeric foam contains a first volume of material similar to the first volume at section 5-5 in FIG. 5, but with the addition of a volume of extra polymeric foam retained in the longitudinal groove formed by the rounded pleat in the speaker edge.

FIG. 8 is a cross-sectional view similar to FIG. 7 but with the volume of the rounded pleat completely filled with polymeric foam.

FIG. 9 is a cross-sectional view similar to FIG. 7 but with the volume of the rounded pleat not completely filled with polymeric foam.

FIG. 10 is a cross-sectional view similar to FIG. 7 except the volume of the extra polymeric foam in the rounded pleat is asymmetrically disposed across the cross-section of the pleat.

DETAILED DESCRIPTION OF THE PREFERRED EMBODIMENTS

Figure 1:
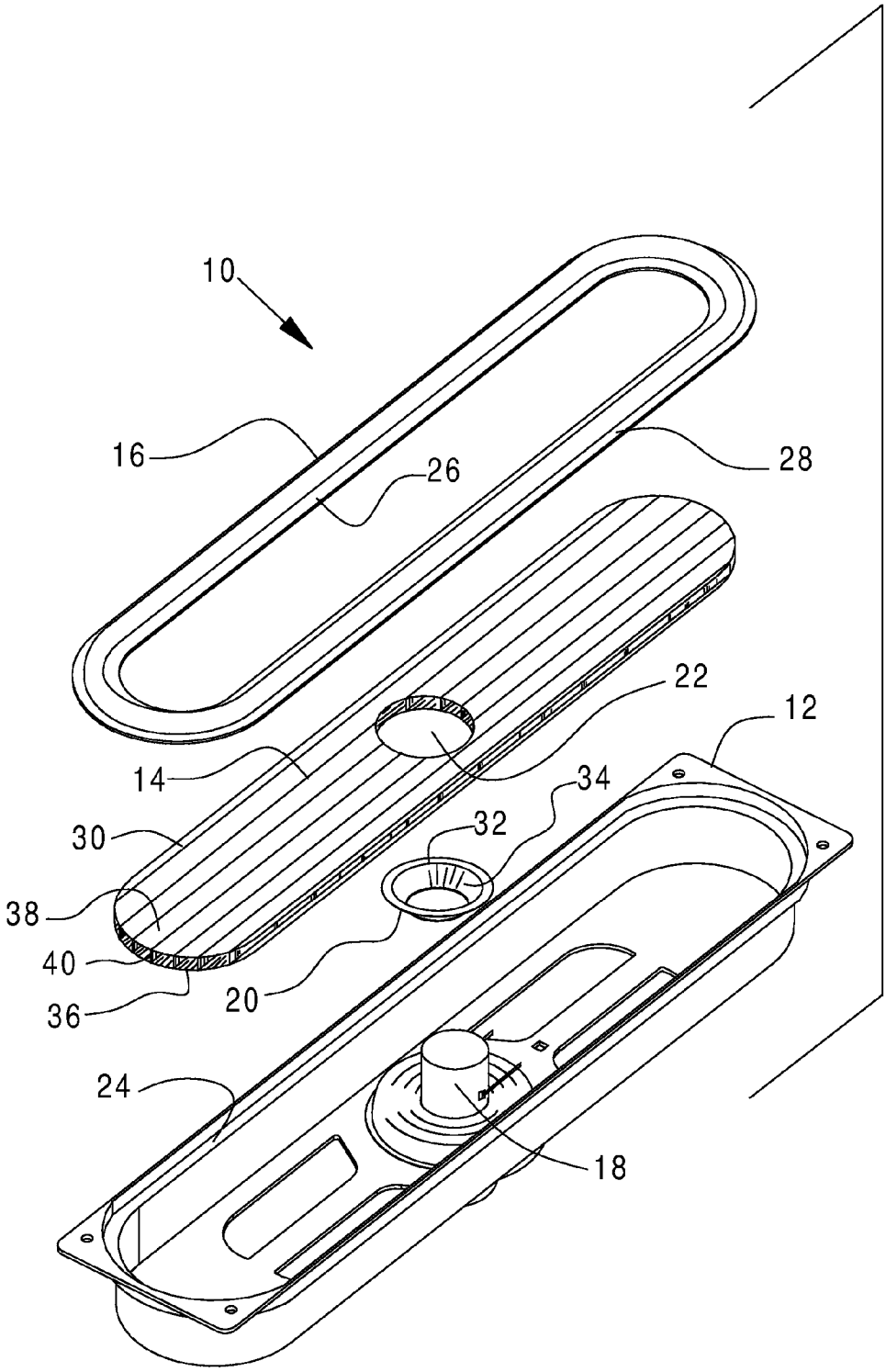
FIG. 1 is a diagrammatic exploded perspective view of an embodiment of a complex speaker edge incorporated in a flat high aspect ratio speaker assembly with a planar resonator panel.

Referring now to the drawings wherein like reference numerals designate identical or corresponding parts throughout the several views. It is to be understood that the drawings are diagrammatic and schematic representations of various embodiments, and are not to be construed as limiting in any way. The use of words and phrases herein with reference to specific embodiments is not intended to limit the meanings of such words and phrases to those specific embodiments. Words and phrases herein are intended to have their ordinary meanings, unless a specific definition is set forth at length herein.

Referring particularly to the drawings, there is illustrated generally at 10 (FIG. 1) a speaker assembly, which includes a planar acoustic resonator panel 14 having an aspect ratio of approximately 4.5 to 1, a radiator 20 with a short conical body 34 mounted through flange 32 in acoustic vibration communication relationship to the perimeter of hole 22 in panel 14, a resonator driver 18 for acoustically driving radiator 20, a frame 12, and a complex speaker edge 16. The configuration of the source of acoustic vibration is not critical. Those skilled in the art are familiar with many different radiator shapes, and with many different drivers. New vibration sources become available from time to time. The complex edge embodiments are not limited to any particular source of acoustic vibration. The resonator panel 14 is a composite construct composed of a top panel 30, and a bottom panel 36 held in spaced apart relationship from top panel 30 by means of a plurality of longitudinally extending ribs of which 40 is typical. Resonator panel 14 thus comprises a plurality of longitudinally extending chambers of which 38 is typical. Resonator panel 14 is useful, for example, in optimizing the speaker edge before the rib angle is adjusted. The radially outermost perimeter 28 of complex speaker edge 16 is adapted to being adhereingly affixed to the boundary 24 of frame 12. The opposed innermost perimeter 26 of complex speaker edge 16 is adapted to being adhereingly affixed to the outer perimeter of resonator panel 14. Panel 14 is thus mounted to frame 12 through complex speaker edge 16.

A wide variety of materials have been previously used for speaker edges and resonator panels. The selection of materials for use in the construction of speaker edges and resonator panels is within the capability of those of ordinary skill in the art. Following the teachings herein one skilled in the art will be able to select specific materials for the construction of complex speaker edges and radiator panels.

Figure 2:
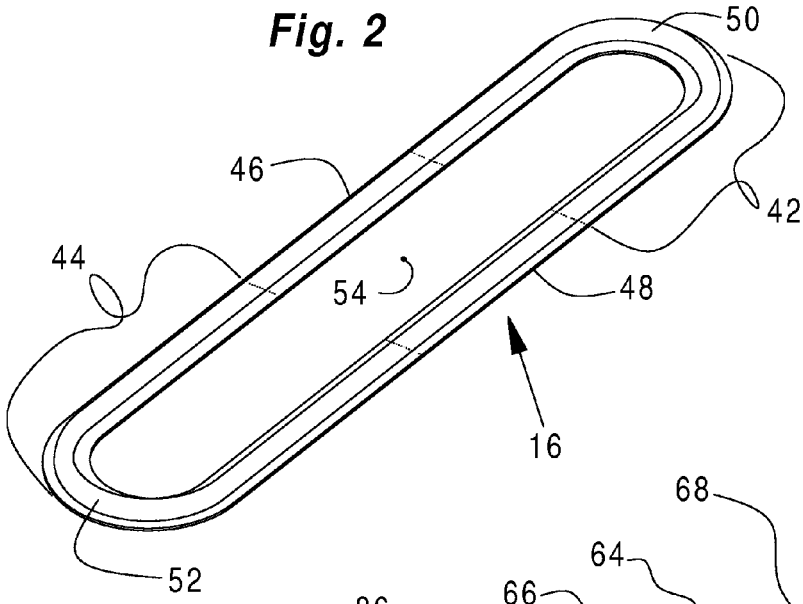
FIG. 2 is a diagrammatic perspective view of the embodiment of a complex speaker edge of FIG. 1.

With particular reference to FIG. 2, the complex speaker edge indicated generally at 16 includes ends 50 and 52, first sections 42 and 44, and second sections 46 and 48, with second sections 46 and 48 being longitudinally intermediate the ends 50 and 52. Point 54 is the center of a source of acoustic vibrational energy, which source is not shown. The acoustical vibration damping characteristics of the first sections 42 and 44 are generally greater than those of the second sections 46 and 48. In general, the complex speaker edge 16 is manufactured so that the physical properties of at least density and/or flexibility differ between the first and second sections. As a first assumption it is assumed that these sections will have different acoustic damping capacities because of the different densities and/or flexibilities. The resulting complex speaker edges are then tested to determine whether the curve of sound pressure level versus frequency produces a flatter curve than that produced by a comparable single speaker edge made entirely with the same density and/or flexibility of either the first or second sections. Such testing is conveniently conducted, for example, using the resonator panel 14 of FIG. 1 as a standard. Based on these curves, additional speaker edges are made with adjustments to the physical characteristics and similarly tested until the curve achieves the desired degree of flatness. Likewise, the longitudinal extent of the respective sections and the nature and configuration of the transition locations between the respective regions is commonly established by such trial and error.

Figure 3:
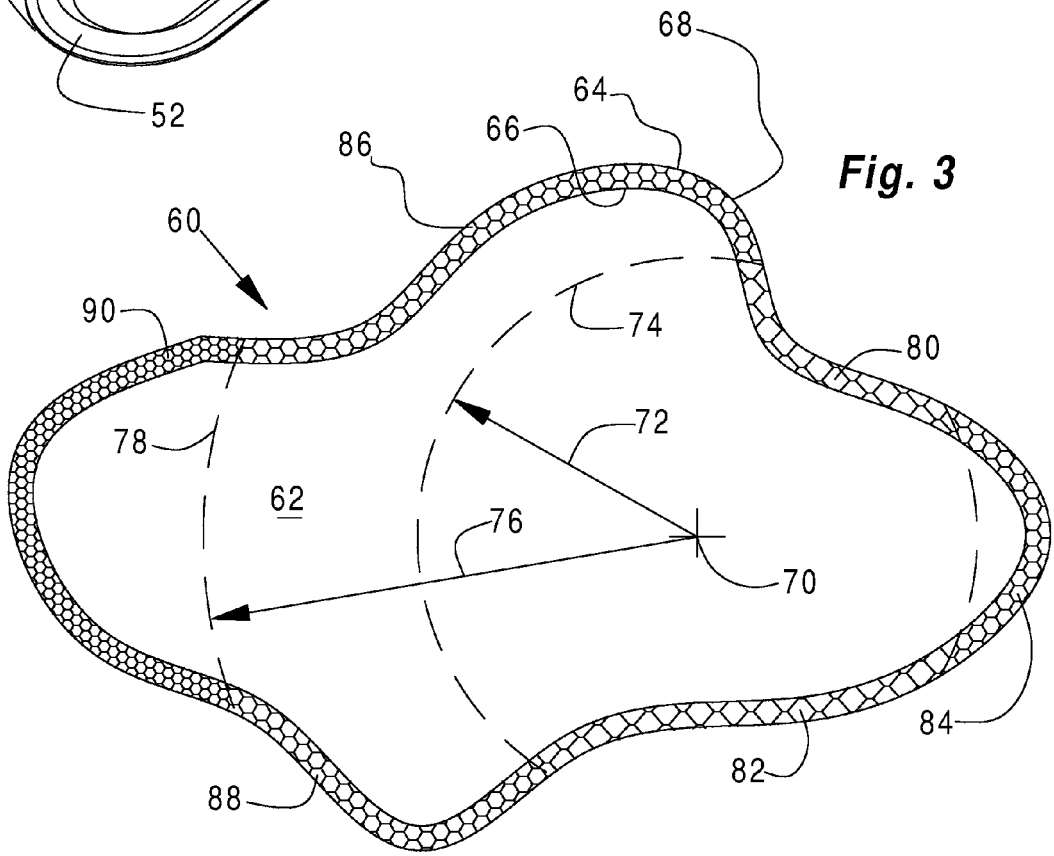
FIG. 3 is a generalized diagrammatic view of a complex speaker edge mounted on a planar resonator panel with an irregular periphery to illustrate the relationship between the acoustic vibration damping characteristics of various sections of the speaker edge relative to their radial spacing from the vibration source.
Figure 11:
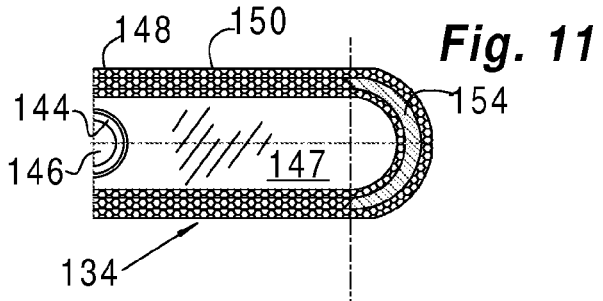
FIG. 11 is a diagrammatic plan view of one-half of a speaker assembly consisting of a source of acoustic vibration, a resonator panel vibratingly associated with that source, and a speaker edge disposed in vibration absorbing relationship with the resonator panel. The sections of the speaker edge exhibit two different acoustic vibration damping capacities. The other half of the speaker assembly is a mirror image of the illustrated half.

A generalized speaker edge-resonator assembly is indicated generally at 60 in FIG. 3. Complex speaker edge 64 is operatively associated with resonator panel 62 in acoustic vibration damping relationship. The radially inner perimeter 66 of the speaker edge is joined to the adjacent outer peripheral edge of resonator panel 62. The outer peripheral edge 68 of the complex speaker edge 64 is adapted to by joined to a frame, not illustrated. The acoustic vibration damping characteristics of the complex speaker edge vary depending roughly on the radial distance from the center 70 of a source of acoustic vibration. Thus, sections 80 and 82 are within the circle 74 defined by the sweep of radius 72. Sections 80 and 82 have generally the same acoustic vibration damping capabilities. Sections 84, 86 and 88 fall between circle 74 and circle 78, within the region swept by radius 76, and sections 84, 86, and 88 all have about the same vibration damping characteristics. Section 90 falls outside of the region swept by radius 76, and has yet different vibration damping capacities from those of either of the other two sections. Typically, the vibration damping capacity of the speaker edge increases as the radial distance from center 70 increases, however the reverse configuration can be employed in some circumstances. For ease of manufacturing, the transitions between the three different vibration capacity sections are abrupt. Disregarding manufacturing costs and difficulty, these transitions could, if desired, be made gradually so that the vibration damping characteristics gradually grade from one capacity to another longitudinally around the complex speaker edge depending on the radial distance from the center 70 of the vibration source. The performance of the complex speaker edge could thus be optimized with great precision and optimum acoustical results, but such a high degree of optimization is generally not necessary. According to the present invention, manufacturing costs and difficulty can be minimized by abrupt stepwise transitions between sections. In general, the transitions should be tapered or feathered as shown, for example, between sections 82 and 84, rather than straight across the speaker edge as shown, for example, at the transition between sections 86 and 90.

FIG. 4 depicts a complex speaker edge indicated generally at 96 wherein planes 98 and 100 show the transition locations between first and second sections of which first section 95 and second section 94 are typical. FIGS. 5 through 10 indicate various ways of changing the acoustic vibration damping capacities of sections 94 and 95. FIG. 5 is a cross-sectional view of the first section 94 in FIG. 4 taken along section line 5-5. FIG. 6 is a cross-sectional view of second section 95 taken along sectional line 6-6 in FIG. 4. The physical cross-sectional form of the speaker edge is shown in FIG. 5 wherein peripheral edges 106 and 108 are joined together through a semicircular pleat 104. Pleat or channel 104 forms a channel or groove extending in the longitudinal direction around the speaker edge 96 median the opposed peripheral boundaries thereof. The opposed peripheral edges 106 and 108 are adapted to be joined, for example, by an adhesive, by solvent welding, sonic welding, fusion, or the like, to a resonator panel on one side and a frame on the opposed side. The opposed peripheral edges 106 and 108 are integrally joined to the pleat or channel 104 at junctions 112 and 110, respectively. The cross-sectional shape of channel 104 can be adjusted from arcuate or angular and from symmetrical to asymmetrical as may be desired. The opposed boundaries 106 and 108 can be adjusted to be the same or different to accommodate any desired design considerations. The section 94 is composed of a material 102. This material can be, for example, a thermally compressed polymeric foam, a molded material, a cast material, or the like. In FIG. 6, the material 114 is denser by at least about 1.1 times, and less flexible than the material 102. The material 114 thus has acoustic vibration damping characteristics that are substantially different from those exhibited by material 102. The effectiveness of such differential damping capacities in flattening the sound pressure level-frequency curve can be determined as described elsewhere herein. In the embodiment of FIG. 7, the cross-sectional view taken along section lines 6-6 in FIG. 4 depicts material 116 in second section 95, which is substantially the same as material 102 in first section 94. The vibration damping capacity of the embodiment of FIG. 7 is provided by the inclusion of a body of material 118 partially filling channel 104. Material 118 can be the same or different from material 116. In the embodiment of FIG. 8, the cross-sectional view taken along section lines 6-6 in FIG. 4 depicts material 120 in second section 95, which is substantially the same as material 102 in first section 94. The vibration damping capacity of the embodiment of FIG. 8 is provided by the inclusion of a body of material 122 fully filling channel 104. Material 122 can be the same or different from material 120. In the embodiment of FIG. 9, the cross-sectional view taken along section lines 6-6 in FIG. 4 depicts material 124 in second section 95, which is substantially the same as material 102 in first section 94. The vibration damping capacity of the embodiment of FIG. 9 is provided by the inclusion of a body of material 126 partially filling channel 104 to a somewhat greater extent than material 118 fills the channel in the embodiment of FIG. 7. Material 126 can be the same or different from material 124. The embodiment of FIG. 10 is similar to the embodiment of FIG. 7 with material 128 being the same or similar to material 102, except that the body of material 130 is shifted so that is asymmetrically disposed within the cross-section of channel 104.

The cross-sectional views of the embodiments depicted in FIGS. 6 through 10 are taken through the complex speaker edge along section line 6-6 or its equivalent in the embodiments of FIGS. 7 through 10. These same cross-sectional configurations could as well be employed in the section where cross-sectional line appears. For example, the cross-sectional forms shown in FIGS. 5 and 6 could interchanged with any of those shown in FIGS. 7 through 10 so long as the complex nature of the speaker edge is maintained.

FIGS. 11 through 15 and 17 illustrate in plan form various embodiments of complex speaker edges according to the present invention. In these embodiments the resonator panel 147, the radiator 144 and the driver 146 are common to all embodiments. In all embodiments the speaker edge is mounted to the outer periphery of the resonator panel 147. In the embodiment 134 of FIG. 11 the complex speaker edge 150 has a first section 148 and a second section 154. Different speaker vibration damping capacities are provided by inserting a body of material in the longitudinally extending channel as shown, for example, in cross-section in FIGS. 7 through 10.

Figure 12:
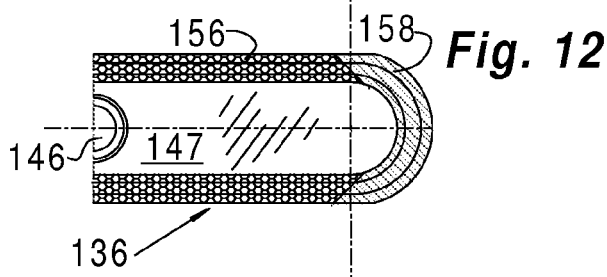
FIG. 12 is similar to FIG. 11 illustrating a further embodiment with a modified section.
Figure 13:
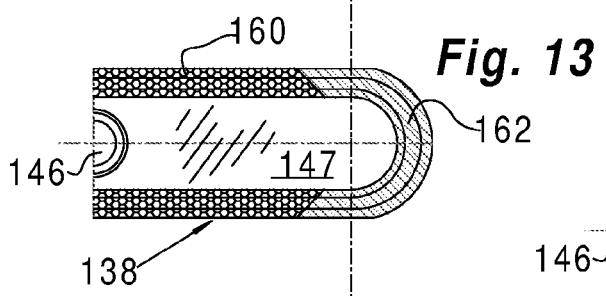
FIG. 13 is similar to FIG. 11 illustrating a further embodiment with a modified and longitudinally extended section.

In the embodiment 136 of FIG. 12 the complex speaker edge has a first section 156 and a second section 158. Different speaker edge vibration damping capacities are provided by using a greater volume of material in second section 158 as shown, for example, in cross-section in FIGS. 5 and 6. The embodiment 138 of FIG. 13 is similar to that of FIG. 12 except that second section 162 extends further towards driver 146 thus radially shortening first section 160. The intersection between sections 162 and 160 is tapered or feathered at an angle of approximately 45 degrees. This tapering of the junction between the two sections has been found to contribute to flattening the sound pressure level-frequency curve as compared with the same structure where the junction is cut straight across at about 90 degrees to the longitudinal axis of the speaker edge.

Figure 14:
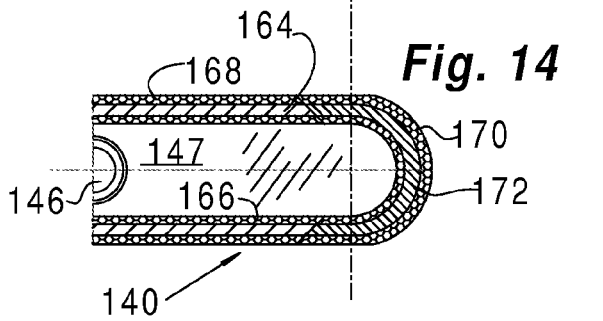
FIG. 14 is similar to FIG. 11 illustrating a further embodiment with modified sections.

In the embodiment 140 of FIG. 14, the opposed boundaries 168 and 166 of the complex speaker edge have about the same characteristics. The channel 164 has physical characteristics that differ from those of the opposed boundaries 166 and 168. The channel in end section 170 differs in its physical characteristics from channel 164 in the median section.

Figure 15:
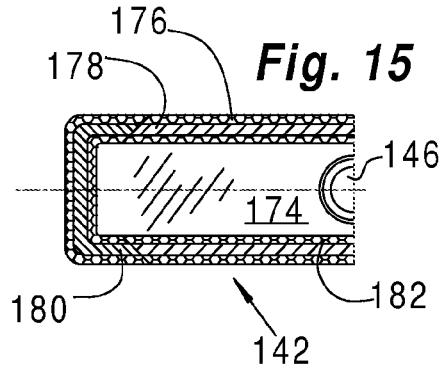
FIG. 15 is similar to FIG. 11 illustrating a further embodiment illustrating a different plan form. Various plan forms can be accommodated by the various embodiments. This provides great flexibility to the speaker designer in fitting the speaker into the available space in a particular design.

The embodiment 142 in FIG. 15 is similar to the embodiment of FIG. 14 except that the end of the resonator panel 174 is squared off rather than being rounded, and the speaker edge is shaped to conform to the plan form of the resonator panel 174. The inner 182 and outer 176 boundaries are similar in their physical characteristics. The physical characteristics of the channel 178 in the first section are different from those in the channel 180 in the second section.

Figure 17:
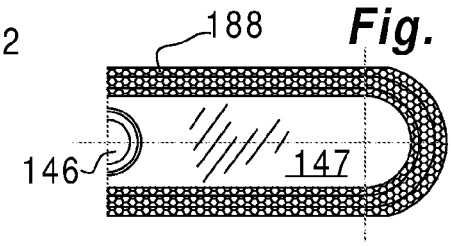
FIG. 17 is similar to FIG. 11 except that for reference purposes it depicts a single speaker edge in which there is no significant change in acoustic vibration damping capacity longitudinally around the speaker edge.

FIG. 17 is provided to illustrate a single speaker edge in which the acoustic vibration damping properties of the speaker edge 188 are substantially constant around the entire longitudinal length of the speaker edge.

The various speaker edges illustrated in FIGS. 11 through 15 can be oriented with the pleat or channel depending in either direction from the normally outer surface of the resonator panel, and there may be two or more channels in a single speaker edge, if desired. The pleat or longitudinally extending channel is provided to afford the capacity for the speaker edge to accommodate large excursions in the movement of the resonator panel as it vibrates. The present invention is not limited to any particular shape that may be used to accommodate the movement of the resonator panel.

Figure 16:
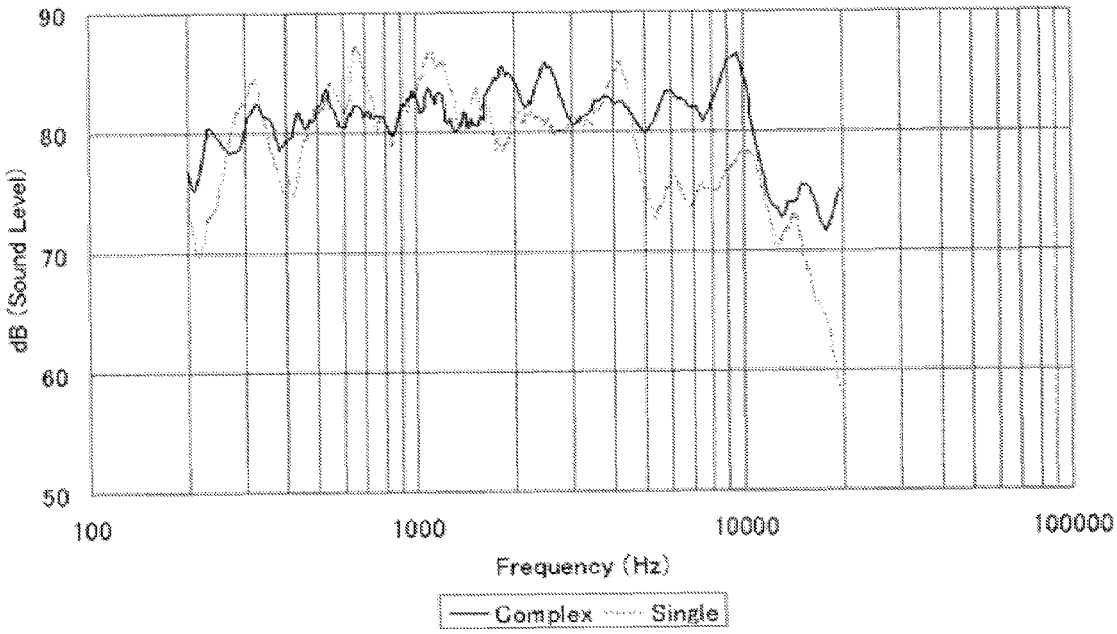
FIG. 16 shows two curves of sound pressure level versus frequency. One curve is for a complex speaker edge and the other is for a simple edge. The two speaker assemblies, except for the speaker edges, are substantially the same so the differences in the curves reflect the differences in the acoustic vibration damping characteristics of the respective speaker edges.

FIG. 16 depicts the sound level pressure versus frequency curves for a complex speaker edge and a single speaker edge. The speaker assemblies that were used to generate these two curves were the same except that the single speaker edge in the assembly that generated the dotted curve was substantially constant around the entire longitudinal length of the speaker edge as shown, for example, in FIG. 17. The complex speaker edge in the assembly that generated the solid curve was divided into two sections having different acoustic vibration damping characteristics as shown, for example, in FIG. 12. An ideal speaker assembly would generate a straight line at, for example, 80 decibels. The quality of the sound generated by the assembly containing the complex speaker edge is better than that of the assembly including the single speaker edge. This can be seen by comparing the magnitude of the excursions of the dotted curve from the nominal 80 decibels line with those of the solid curve over the same range of frequencies. The average magnitude of the excursions differ by at least 5 percent with the solid curve being flatter than the dotted curve. This difference is easily detected by the human ear and detracts significantly from the hearers listening pleasure. The differences are particularly noticeable at the higher and lower frequencies. Even differences of as little as about two or three percent are detectable by the human ear. At the higher and lower frequencies differences of as much as about 25 to 50 percent or more exist, and these are very noticeable to a listener. From about 200 to 10,000 Hertz the average magnitude of the differences in the excursions of the respective curves from the nominal 80 decibels is at least about 5 and often at least about 10 percent.

Figure 18:
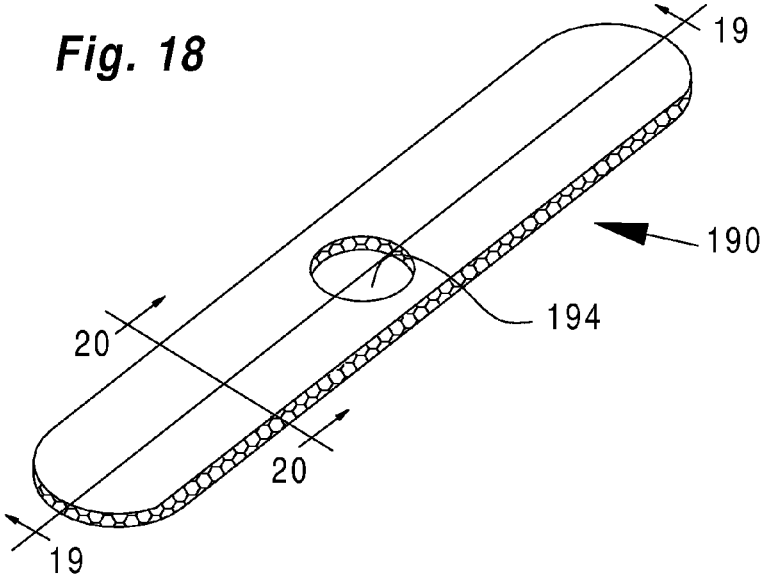
FIG. 18 is a diagrammatic perspective view of a foam filled resonator panel.
Figure 19:
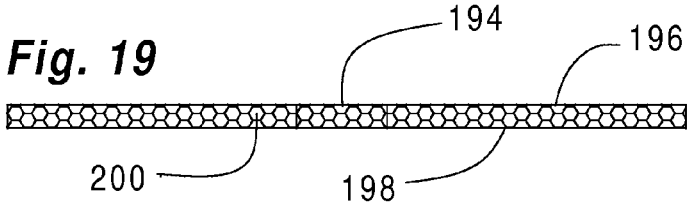
FIG. 19 is a cross-sectional view taken along section line 19-19 in FIG. 18.
Figure 20:
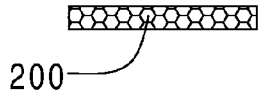
FIG. 20 is a cross-sectional view taken along section line 20-20 in FIG. 18.

FIGS. 18 through 20 diagrammatically depict a high aspect ratio foamed resonator panel indicated generally at 190, which is suitable for use with complex edges as a standard for testing purposes before optimization with angled rib resonator panels. Panel 190 includes a hole 194 to accommodate the mounting of a radiator, a top solid panel 194, a bottom solid panel 198, and a foam core 200 between the solid panels 196 and 198. The density of the panels and the foam, and the thickness of the foam core are constant throughout.

Figure 21:
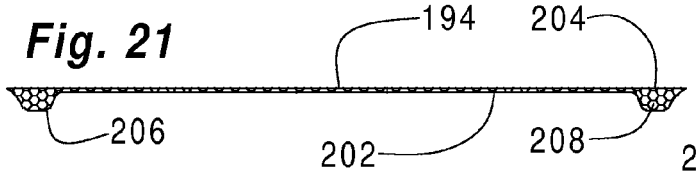
FIG. 21 is a cross-sectional view similar to FIG. 19 of a further embodiment of a foam filled resonator panel.
Figure 22:
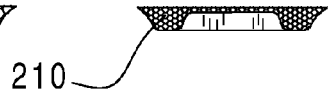
FIG. 22 is a cross-sectional view similar to FIG. 20 of the embodiment of FIG. 21.

FIGS. 21 and 22 depict diagrammatically a further embodiment of a resonator panel for test purposes where the bottom panel 202 is shaped into a foam filled stiffener bead 206 that is located adjacent the periphery of the panel. The density of the foam core at location 208 at the end of the resonator panel differs from that at location 210. This differential density, as well as the presence of the stiffener rib or bead 206 has an influence on the sound generated by the resonator panel. The change in the density of the foam between locations 208 and 210 can be gradual or abrupt as may be desired.

Figure 23:
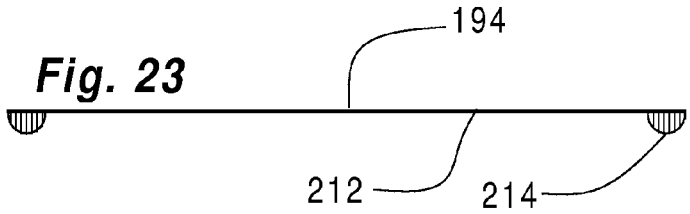
FIG. 23 is a cross-sectional view similar to FIG. 19 of a further embodiment of a foam filled resonator panel.
Figure 24:
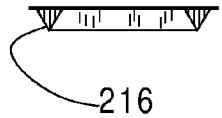
FIG. 24 is a cross-sectional view similar to FIG. 20 of the embodiment of FIG. 23.

FIGS. 23 and 24 depict a further embodiment of a resonator panel that is useful for test purposes. A single stiff solid panel is reinforced with a foam filled peripheral bead or rib, which bead or rib has a different form at location 214 from that at location 216. The transition from one form to another can be gradual or abrupt as may be desired. Again, the presence of and variations in the form of the peripheral or annular bead or rib longitudinally of the resonator panel influences the sound produced by the resonator.

Figure 25:
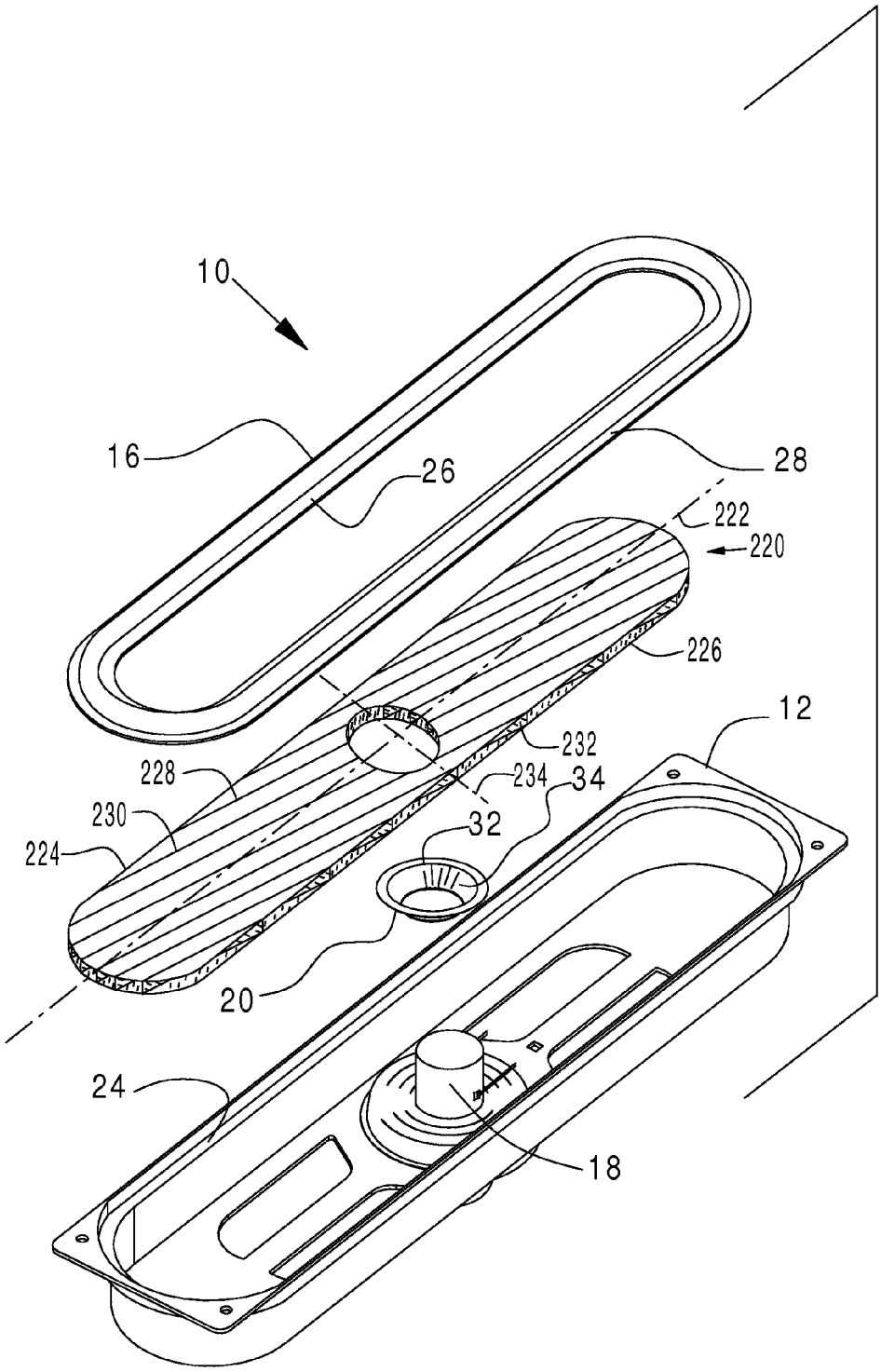
FIG. 25 is a view similar to FIG. 1 illustrating a diagrammatic exploded perspective view of an embodiment of a complex speaker edge incorporated in a flat high aspect ratio speaker assembly with a planar resonator panel having ribs extending at an acute rib angle of approximately 10 degrees.

FIG. 25 is illustrative of embodiments in which exemplary ribs 228, 230, and 232 in the resonator panel indicated generally at 220 extend within the plane of the resonator panel at an acute angle to the longitudinal axis 222. Lateral axis 234 of resonator panel 220 extends generally normal to longitudinal axis 222. The ribs are sandwiched between top panel 224 and bottom panel 226. These panels are described as top and bottom merely for purposes of description and not to indicate that one is normally above the other relative to the horizon. Orientation relative to the horizon generally has little or no effect on the characteristics of sound emitted by a speaker assembly. Resonator panel 220 is asymmetric with the longitudinal axis 222 being longer than lateral axis 234. That is, longitudinal axis 222 is the major axis of the resonator panel.

The aspect ratio of resonator panel 220 generally ranges from approximately 1 to 1.3 to 1 to 20 or higher with aspect ratios of from approximately 1 to 2 to 1 to 12 being common. The acute angle at which the generally straight ribs extend from the longitudinal axis generally ranges from approximately 5 to 35 degrees with angles of from approximately 5 to 20 or 10 to 20 degrees being very useful. The speaker edge and the resonator panel should be acoustically matched to one another. The sound quality of a speaker assembly can not be optimized unless both the speaker edge and the resonator panel are performing their intended functions. If the sound level pressure frequency is not made as flat as possible by a properly designed speaker edge, adjustments made to the rib angle will generally not produce any detectable changes because the overall sound quality will be too poor. Changes in the rib angle may require further adjustments in the characteristics of the speaker edge. In general, the more accurate the reproduction of the acoustic vibration generated by the resonator driver, the more enjoyable the listening experience will be.

In certain embodiments the resonator panel is approximately flat although some arcuatness or angularity is permissible so long as it does not significantly interfere with the basic requirement that the speaker assembly be as flat as possible. The resonator panel can be composite or simple in its construction. The plan form of the resonator panel generally exhibits an aspect ratio or other arrangement such that the radial distance from the source of vibration to the speaker edge varies around the perimeter of the speaker edge.

It is well known in the art that different speaker assemblies begin to emit meaningful sound, that is, sound that can be recognized by the human ear for what it is intended to be at anywhere from approximately 30 to 200 HZ. Embodiments provide advantages at and near the point at which the speaker assemblies in which they are incorporated begin to emit meaningful sound. These advantages typically take the form of improved sound quality and lowered frequencies at which meaningful sound is first emitted. In general, the frequencies at which meaningful sound are first produced are at least as low as 100 Hz and can be as low as 75 Hz or even lower.

It will be appreciated that the objectives of the present invention may be accomplished by a variety of devices and structures other than those specifically disclosed embodiments. Accordingly, the present invention should not be construed as limited solely to the disclosed embodiments.

What have been described are embodiments in which modifications and changes may be made without departing from the spirit and scope of the accompanying claims. Many modifications and variations of the disclosed embodiments are possible in light of the above teachings. It is therefore to be understood that, within the scope of the appended claims, the invention may be practiced otherwise than as specifically described.

What is claimed is:

1. A matched complex speaker edge and asymmetric resonator panel in a speaker assembly, said asymmetric resonator panel having an aspect ratio of approximately 2:1 or more, a longitudinal axis, a lateral axis extending generally normal to said longitudinal axis, said longitudinal axis being the longer of the two axes, said asymmetric resonator panel comprising top and bottom panels held in spaced apart relationship by a plurality of generally straight ribs extending generally parallel to one another therebetween, said ribs extending generally at an angle to said longitudinal axis of from approximately 5 to 35 degrees, a source of acoustic vibration vibratingly associated with said asymmetric resonator panel, said complex speaker edge comprising at least two sections, a first of said sections having a first acoustic vibration damping characteristic, and a second of said sections having a second acoustic vibration damping characteristic, and said first and second acoustic vibration damping characteristics being sufficiently different from one another to produce a difference of at least about 2 percent in the average magnitude of the excursions of the respective sound level pressure-frequency curves, said angle being acoustically matched to said complex speaker edge to improve the accuracy with which said acoustic vibration is reproduced by said speaker assembly.

2. A matched complex speaker edge and asymmetric resonator panel of claim 1 wherein said complex speaker edge is composed of thermally compressed foamed polymer, said first and second sections have substantially the same physical form, and said second section is at least about 1.1 times denser than said first section.

3. A matched complex speaker edge and asymmetric resonator panel of claim 1 wherein said first acoustic vibration damping characteristic is greater than said second acoustic vibration damping characteristic.

4. A matched complex speaker edge and asymmetric resonator panel of claim 1 wherein said first acoustic vibration damping characteristic is less than said second acoustic vibration damping characteristic.

5. A matched complex speaker edge and asymmetric resonator panel of claim 1 wherein said difference in the average magnitude of the excursions of the respective sound level pressure-frequency curves is at least about 5 percent.

6. A matched complex speaker edge and asymmetric resonator panel for use in a speaker assembly, said speaker assembly including a source of acoustic vibration vibratingly associated with an elongated resonator panel, said elongated resonator panel having an aspect ratio of approximately 2:1 or more, a longitudinal axis and a lateral axis, said longitudinal axis being the longer of the two axes, and comprising top and bottom panels held in spaced apart relationship by a plurality of generally straight angularly extending ribs extending therebetween, said angularly extending ribs extending generally at an acute angle to said longitudinal axis, said acute angle being from approximately 5 to 35 degrees, and said acute angle being acoustically matched to said complex speaker edge to improve the accuracy with which said acoustic vibration is reproduced by said speaker assembly, said complex speaker edge comprising at least a first section and a second section, said first section being closer to said source of acoustic vibration than said second section, said first and second sections having different acoustic vibration damping characteristics, and said first and second acoustic vibration damping characteristics being sufficiently different from one another to produce a difference of at least about 5 percent in the average magnitude of the excursions of the respective sound level pressure-frequency curves at a range of from about the lowest frequency at which said speaker assembly produces meaningful sound to approximately 10,000 hertz.

7. A matched complex speaker edge and asymmetric resonator panel of claim 6 wherein said acute angle is from approximately 10 to 20 degrees.

8. A planar speaker assembly including a complex speaker edge in vibration damping association with a resonator panel, said resonator panel having an aspect ratio of at least about 1.3 to 1, a longitudinal axis and a lateral axis, said axes extending generally normal to one another, said longitudinal axis being the longer of the two axes, top and bottom panels held in spaced apart relationship by a plurality of generally straight ribs extending therebetween at an angle of from approximately 5 to 35 degrees, a source of acoustic vibration, said elongated resonator panel being acoustically matched to said complex speaker edge to improve the accuracy with which said acoustic vibration is reproduced by said planar speaker assembly, said complex speaker edge comprising at least two sections, a first of said sections having a first acoustic vibration damping characteristic, and a second of said sections having a second acoustic vibration damping characteristic, and said first and second acoustic vibration damping characteristics being sufficiently different from one another to produce a difference of at least about 2 percent in the average magnitude of the excursions of the respective sound level pressure-frequency curves.

9. A planar speaker assembly of claim 8 wherein said first section is radially closer to said source of acoustic vibration than said second section.

10. A matched complex speaker edge and asymmetric resonator panel for use in a speaker assembly, said speaker assembly including a source of acoustic vibration vibratingly associated with an elongated resonator panel, said elongated resonator panel having an aspect ratio of approximately 2:1 or more, a longitudinal axis and a lateral axis, said axes extending generally normal to one another, said longitudinal axis being the longer of the two axes, and comprising top and bottom panels held in spaced apart relationship by a plurality of longitudinally extending ribs extending therebetween at an angle of from approximately 5 to 20 degrees, said angle being acoustically matched to said complex speaker edge to improve the accuracy with which said acoustic vibration is reproduced by said speaker assembly, said complex speaker edge comprising at least a first section and a second section, said first section being closer to said source of acoustic vibration than said second section, said first and second sections having different acoustic vibration damping characteristics, and said first and second acoustic vibration damping characteristics being sufficiently different from one another to produce a difference of at least about 5 percent in the average magnitude of the excursions of the respective sound level pressure-frequency curves at a range of from about 200 to 400 hertz.

* * * * *